United States Patent [19]

Boyadjieff

[11] Patent Number: 4,489,794

[45] Date of Patent: Dec. 25, 1984

[54] LINK TILTING MECHANISM FOR WELL RIGS

[75] Inventor: George I. Boyadjieff, Anaheim, Calif.

[73] Assignee: Varco International, Inc., Orange, Calif.

[21] Appl. No.: 490,679

[22] Filed: May 2, 1983

[51] Int. Cl.[3] ..... E21B 19/06

[52] U.S. Cl. ..... 175/85; 166/77.5; 414/22

[58] Field of Search ..... 175/85, 52, 161; 166/85, 77.5; 294/90, 102 A; 92/34, 42–46; 414/22

[56] References Cited

U.S. PATENT DOCUMENTS

| | | | |
|---|---|---|---|
| 1,997,565 | 4/1935 | Arbuckle | 92/46 |
| 2,313,243 | 3/1943 | Johnson | 414/22 |
| 2,324,173 | 7/1943 | Porter | 92/46 |
| 2,613,102 | 10/1952 | Roberson | 414/22 |
| 3,063,509 | 11/1962 | Guier | 175/85 |
| 3,368,699 | 2/1968 | Scaggs | 175/85 |
| 3,464,507 | 9/1969 | Alexander et al. | 175/85 |
| 3,766,991 | 10/1973 | Brown | 175/85 |
| 3,857,450 | 12/1974 | Guier | 175/85 |
| 3,915,244 | 10/1975 | Brown | 175/85 |
| 4,326,745 | 4/1982 | Guier | 294/90 |

*Primary Examiner*—James A. Leppink
*Assistant Examiner*—Hoang C. Dang
*Attorney, Agent, or Firm*—William P. Green

[57] ABSTRACT

Well apparatus including elevator links connected to a hook or other unit suspended in a derrick and hanging therefrom at opposite sides of the well axis to support an elevator or the like, with power actuated means provided for swinging the lower ends of the links laterally outwardly relative to the upper ends of the links and essentially about those upper ends, to shift the suspended elevator to a side of the well axis.

14 Claims, 10 Drawing Figures

FIG. 5
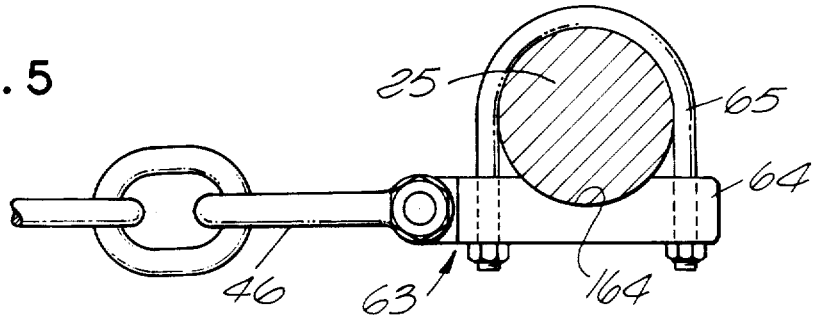
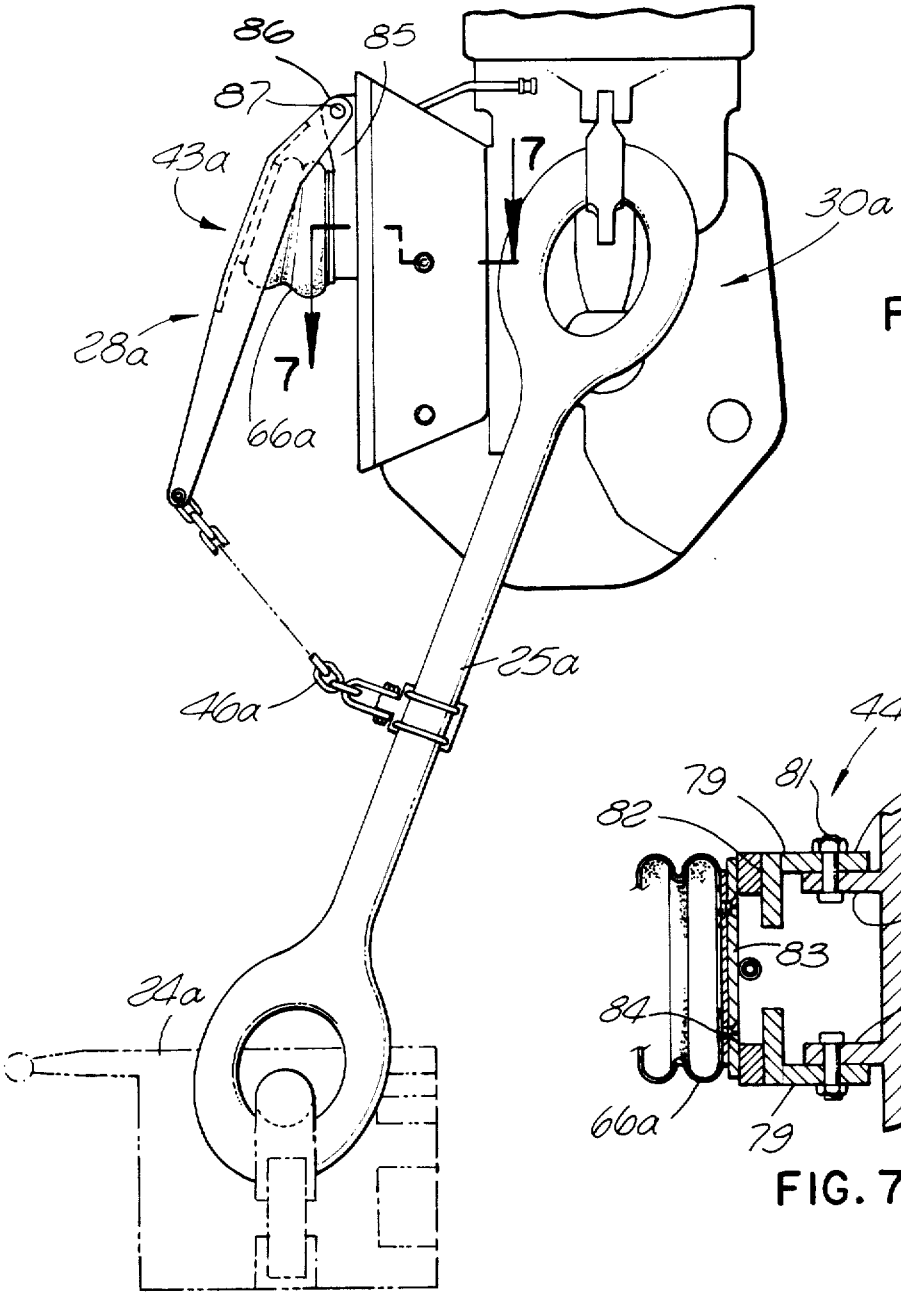
FIG. 6
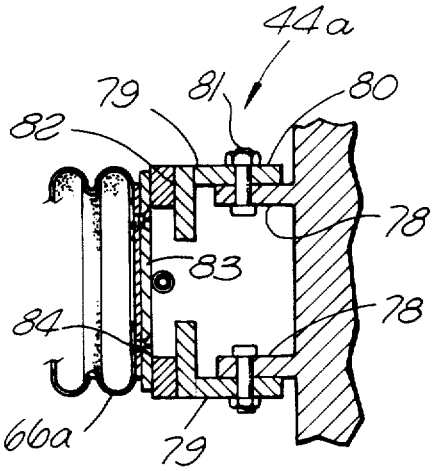
FIG. 7

LINK TILTING MECHANISM FOR WELL RIGS

BACKGROUND OF THE INVENTION

This invention relates to improved apparatus for supporting and moving a section of pipe or other suspended load in a well rig.

In moving a pipe section into or out of position for connection to a drill string in a well, it is customary to utilize hoisting equipment including an elevator which is capable of engaging and supporting the section of pipe and which is suspended from a hook or other supporting unit by two elevator links located at opposite sides of the well axis. When the pipe to be suspended is located in a 'mousehole' at a side of the well axis, or is retained within a rack at a side of the axis, conventional equipment and methods require a person or persons on the rig floor or at an elevated location in the derrick to manually force the elevator laterally from a position of alignment with the well axis to a location in which it can contact and hold the offset section of well pipe. Such movement of the elevator and the links can be very difficult and involve exertion of a great deal of effort accompanied by the possibility of injury to the workmen. Further, this operation may be more time consuming than would be desired.

SUMMARY OF THE INVENTION

The present invention provides power actuated means for effecting such lateral displacement of the links and suspended elevator in order to avoid the above discussed disadvantages of prior arrangements and procedures. These power actuated means function to swing the lower ends of the elevator links laterally outwardly relative to the upper ends of the links, and thereby displace the elevator to a side of the well axis. Preferably, the power operated means are actuable by pressure fluid to effect such movement of the links, desirable by actuation of a bellows arrangement. The power actuated mechanism may include a mounting structure connectable to the side of a well hook or other supporting unit and to which a member is pivotally connected to swing outwardly away from and relative to the mounting structure, with that member being attached to the links by chains or other connections to effect swinging movement of the links in response to the discussed pivotal movement of the member. In one form of the invention, the link actuator may be suspended from a motorized drilling unit which is connected to the upper end of the drill string to drive it during drilling and is bodily moveable downwardly with the string as the drilling progresses.

BRIEF DESCRIPTION OF THE DRAWINGS

The above and other features and objects of the invention will be better understood from the following detailed description of the typical embodiments illustrated in the accompanying drawings, in which:

FIG. 5 is a fragmentary horizontal section taken on line 5—5 of FIG. 2;

FIG. 6 is a side view of a variational form of hook and link tilting assembly;

FIG. 7 is a fragmentary horizontal section taken on line 7—7 of FIG. 6;

DESCRIPTION OF THE PREFERRED EMBODIMENTS

Figure 1:
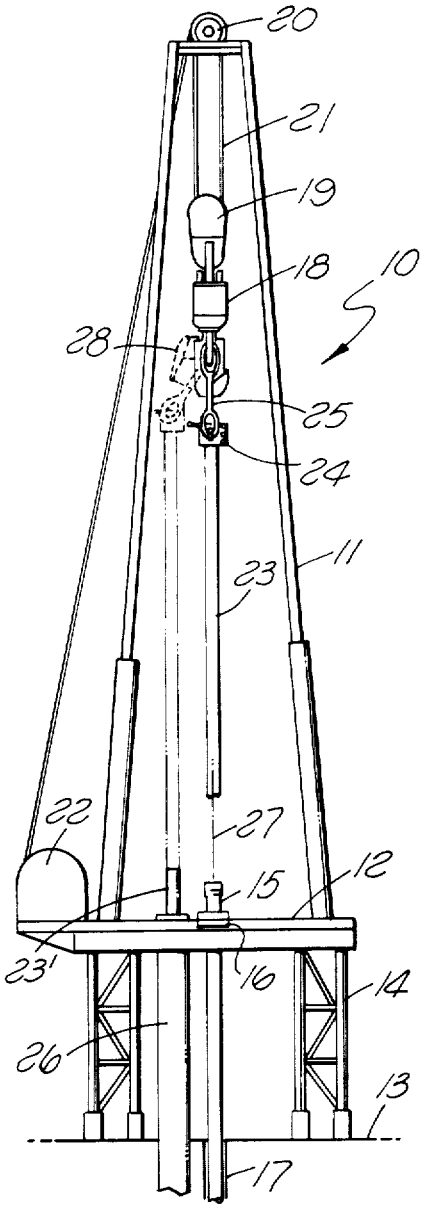
FIG. 1 is a diagrammatic representation of a well rig having a link tilting mechanism constructed in accordance with the invention.

The well drilling rig 10 represented diagrammatically in FIG. 1 includes the usual derick or mast 11 projecting upwardly above a rig floor 12 which may be supported above the surface of the earth 13 by a substructure 14. The drill string 15 may be driven rotatively by a rotary table 16 to drill a well 17. During the actual drilling operation, the drill string 15 may be suspended by a hook 18 supported by a traveling block 19 which is suspended from crown block 20 by a line 21 actuable by draw works 22 to move the traveling block and hook upwardly and downwardly as desired. FIG. 1 illustrates the apparatus as it appears when a length of pipe 23 is being added to the upper end of the drill string 15 or removed therefrom, with the pipe section 23 being suspended from the hook by a conventional elevator 24 carried by two elevator links 25. A mousehole 26 extending downwardly beneath the rig floor 12 at a location offset laterally from the main well axis 27 is adapted to contain the pipe section 23 before it is added to the drill string or after it has been removed therefrom, as represented in broken lines at 23' in FIG. 1. The link tilting mechanism 28 of the present invention is adapted to swing links 25 and elevator 24 laterally to the broken line positions represented in FIG. 1, in a manner locating the elevator directly above and in axial alignment with mouse hole 26 for engagement with the upper end of pipe section 23' to grip that pipe section and remove it upwardly from the mousehole.

Figure 2:
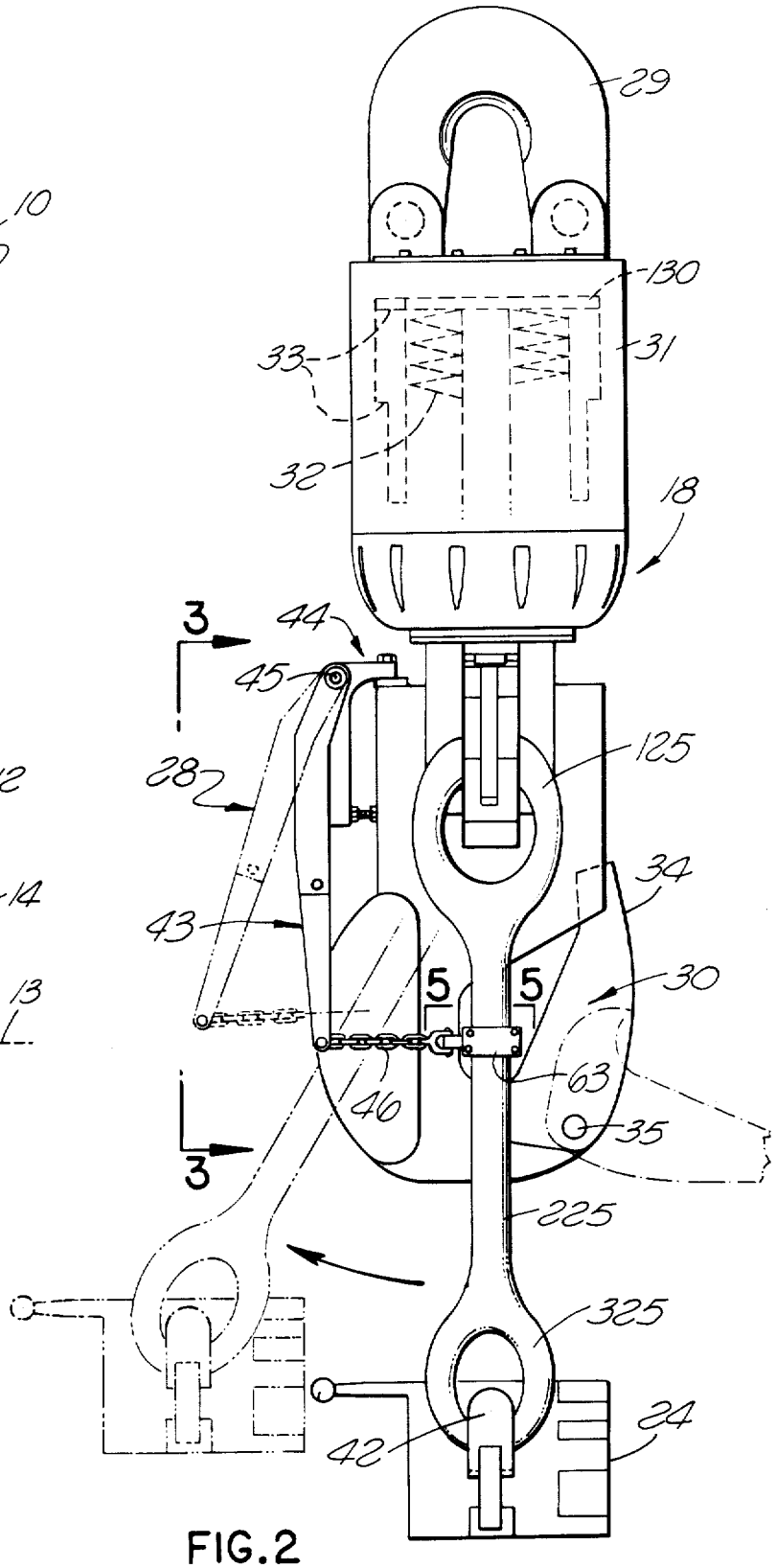
FIG. 2 is an enlarged side elevational view of the hook and link tilting assembly of FIG. 1.

Referring now to FIG. 2, the hook unit 18 may be of any known construction, having an upper bail or other connector element 29 by which the hook is suspended from travelling block 19, and having a lower hook shaped body 30 from which the drill string may be suspended during drilling. Connected rigidly to bail 29, the device 18 may include an upper hollow body 31 which is formed separately from the lower hook shaped body 30 and which contains a spring or springs represented diagrammatically at 32 acting to yieldingly resist downward movement of lower body 30, and a connected element 130 within upper body 31, relative to that upper body. In a lower position of body 30 and element 130 relative to upper body 31, a pair of shoulders 33 on parts 130 and 31 are engageable to transmit load forces between bodies 30 and 31 independently of springs 32. The bail or connector part of a load suspended from lower hook shaped body 30 may be retained in engagement with that hook element by a gate member 34 pivoted to body 30 at 35 for swinging movement between the full line and broken line positions of FIG. 2.

Figure 3:
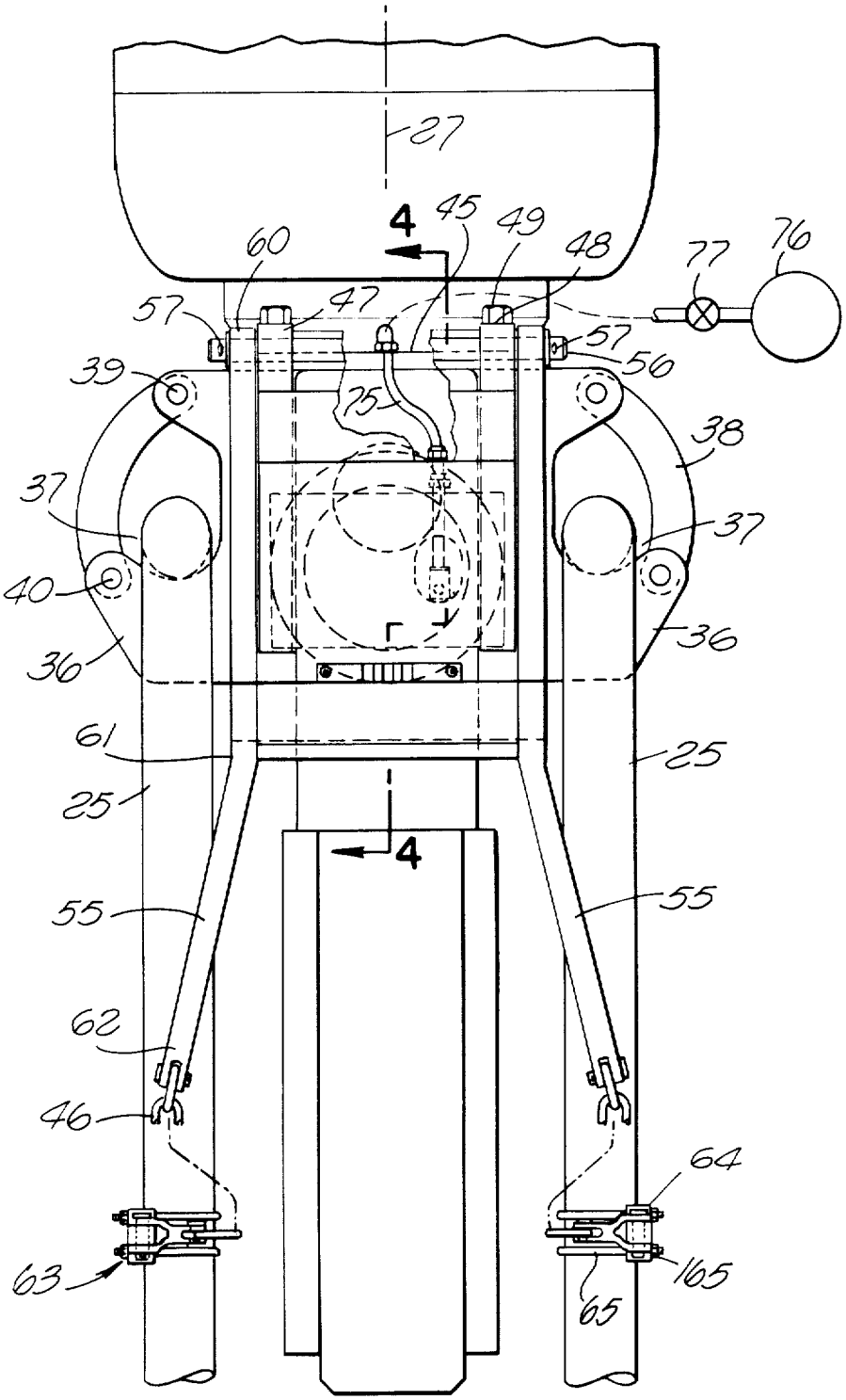
FIG. 3 is an enlarged view taken on line 3—3 of FIG. 2.

As seen in FIG. 3, hook body 30 has a pair of lugs or ears 36 connected rigidly thereto near its upper end and projecting laterally in diametrically opposite directions with respect to the main vertical axis 27 of the well and unit 18. Each of these lugs contains a recess 37 adapted to engage the upper end of a corresponding one of the links 25, with the upper eye 125 of the link extending about lug 36 at the location of recess 37, and with the link being retained against removal from that position by a gate member 38 extending across the open side of recess 37 and secured detachably to the lug above and beneath the recess at 39 and 40.

Links 25 may be of essentially conventional construction, though typically somewhat shorter than standard links in view of the capacity for powered actuation of the links which is made possible by the tilting mechanism 28 of the present invention. Projecting downwardly from its upper eye portion 125, each link 25 has a straight rod-like portion 225, terminating in a lower eye 325 engaging one of two suspending loops of elevator 24. As will be apparent from FIG. 2, the sizes of the eyes 125 and 325 of links 25 are great enough relative to the sizes of the engaged lugs 36 on the hook body and suspending loops 42 of the elevator to permit the links to swing essentially pivotally relative to hook body 30 between the full line and broken line positions of FIG. 2, with the elevator hanging downwardly in a directly vertically extending position in each of the conditions of the links.

The tilting mechanism 28 is attached to a side of lower hook body 30 as seen in FIG. 2, and includes a structure 43 which is connected to a mounting bracket or base 44 for pivotal movement about a horizontal axis 45 between the full line and broken line positions of FIG. 2. Structure 43 is connected by two chains 46 to the two links 25 respectively, to cause swinging movement of the links in response to the discussed pivotal movement of structure 43.

The mounting bracket 44 may be shaped and constructed to enable its attachment to a hook body of any configuration. For attachment to the particular type of hook body 30 illustrated in FIGS. 1 through 4, bracket 44 is illustrated as formed of two identical inverted L-shaped members 47 having upper generally horizontal portions 48 attached by screws 49 to a horizontal plate 41 welded or otherwise rigidly secured to the top of body 30. Projecting downwardly from their upper portions 48, members 47 have essentially vertical portions 50 spaced laterally from body 30, with a vertical plate 51 being welded or otherwise secured to members 50 and connecting them rigidly together. Two screws 52 are adjustably threadedly connected to the downwardly projecting portions 50 of members 47, and have their heads engaging the side surface 53 of hook body 30, so that by adjustment of screws 52 the members 50 can be set in directly vertical positions as shown. Jam nuts 54 about screws 52 are tightenable against portions 50 of members 47 to lock the locating screws 50 in proper positions relative to members 47. The screws 49 and 52 together thus retain mounting bracket 44 in rigidly fixed position at the side of hook body 30.

The pivoting structure 43 of link tilt mechanism 28 may be similarly formed of two elongated generally parallel arms 55 connected by a horizontal pivot pin 56 to the upper ends of portions 50 of members 47, with the pivot pin extending along the previously mentioned axis 45 to mount structure 43 for pivotal movement about that axis. As will be understood, pivot pin 56 extends through aligned openings in the two members 47 and arms 55, to connect the parts for the discussed relative pivotal movement, with the parts being held in assembled relation by extension of cotter keys 57 transversely through the pin at its opposite ends beyond the two arms 55.

In addition to arms 55, the swinging structure 43 includes a rigid generally vertically extending plate 58, which may be welded or otherwise secured rigidly to and extend transversely between the two arms 55. The rigidity of the structure 43 may be further enhanced by provision of two parallel horizontal connecting rods 59 extending between the two arms 55 near the upper and lower edges of vertical plate 58 and welded or otherwise rigidly secured at their opposite ends to the arms 55.

As seen best in FIG. 3, the upper portions of arms 55 may extend directly parallel to one another, from their upper extremities 60 to a location 61 beyond which the two arms 55 may flare generally apart to their lower ends 62 to which chains 46 are connected. At their free ends, chains 46 carry two connectors 63 (FIG. 5), which are detachably connectible to the straight rod like portions 225 of elevator links 25, to exert pulling force thereon. Each of the connectors 63 may include a plate 64 attached to the chain and containing a partial cylindrical recess 164 embracing one side of the cylindrical portions 225 of the corresponding link, with two U-bolts 65 being tightened against the opposite side of the link by nuts 165.

Figure 4:
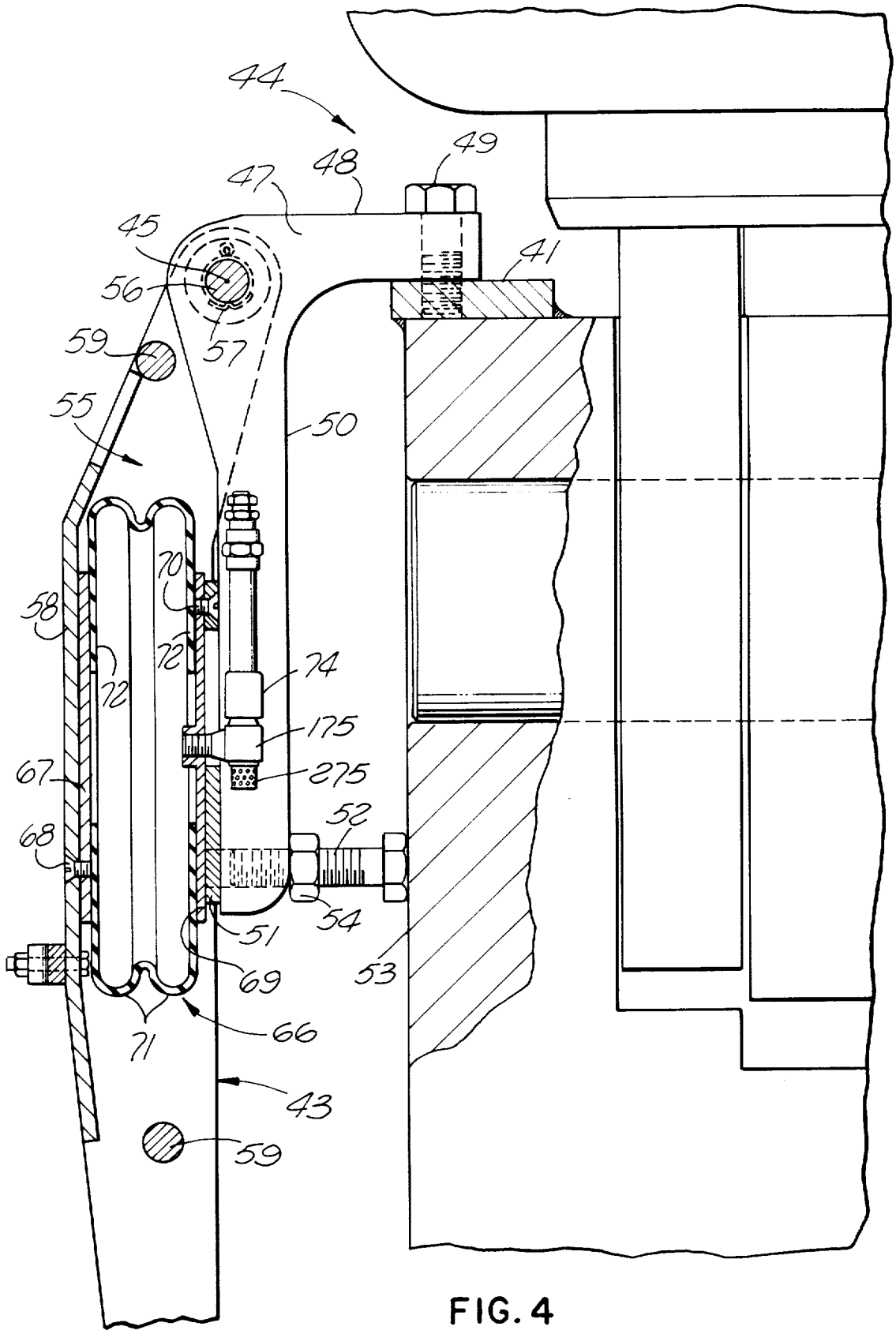
FIG. 4 is a further enlarged vertical section taken on line 4—4 of FIG. 3.

The swinging structure 43 is actuated pivotally between its full line and broken line positions of FIG. 2 by a bellows assembly 66 expansible by fluid pressure to force structure 43 laterally outwardly away from mounting bracket 44. Referring to FIG. 4, this bellows assembly may include a circular metal plate 67 secured to plate 58 of structure 43, as by screws 68, and a second rigid metal end plate 69 secured to plate 51 of mounting bracket 44, as by screws 70. A flexible annular bellow element 71 formed of rubber or the like may have its opposite end wall portions 72 bonded annularly to plates 67 and 69 respectively, to form with those plates a composite variable size sealed bellows enclosure structure which is expansible by internal fluid pressure to swing structure 43 from its full line position of FIG. 2 to its broken position. Air or other pressure fluid is introduced into the interior of this bellows assembly through a tubular inlet fitting 74, connected by a hose 75 to a source of compressed air or other pressurized fluid represented at 76.

Describing now the manner of use of the device of FIGS. 1 through 5, during drilling the swivel and drill string may be suspended in conventional manner from the lower hook shaped portion of body 30 of the hook device 18. When it is desired to add a length of pipe to the upper end of the string, elevator 24 is suspended from the hook device 18 by links 25, as illustrated in FIGS. 1 and 2, and the hook, links and elevator may be lowered to a level at which the elevator is slightly higher than the upper end of the length of pipe 23' within mousehole 26. A valve 77 controlling the admission of air to bellows 66 of link tilting mechanism 28 is then opened to admit compressed air to the interior of the bellows and thereby swing structure 43 from its full line position to its broken line position of FIG. 2, acting through chains 46 to cause corresponding swinging movement of links 25 essentially about their upper eye portions 125 from their full line vertical positions of FIG. 2 to their inclined or tilted broken line positions of that figure. This swinging movement of the links causes elevator 24 to move leftwardly to a position directly above the upper end of the pipe section 23' in mousehole 26, after which the traveling block 19 and hook 18 can be lowered to move the elevator to a position about the upper end of section 23', at which time the elevator can be closed about section 23' to grip it or engage a shoulder at its upper end in a manner enabling the section 23' to be pulled upwardly by the elevator upon upward movement of hook 18 and the links. Section 23' is pulled upwardly in this way far enough to withdraw section 23' completely from the mousehole (broken lines in FIG. 1), after which the pressure in bellows 66 is released to permit links 25 and the elevator and the suspended pipe section to swing by their own weight to the full line positions of FIG. 1, in which the pipe section is suspended directly above the upper end of the drill string 15, and can then be lowered to a position for threaded connection to the drill string. The release of the pressure within the bellows may be effected by merely closing the air supply valve 77 between air source 76 and line 75 leading to the bellows, with the resultant drop in pressure in line 75 functioning to cause a conventional automatic exhaust valve 175 of known construction to open and discharge are from within the bellows to the atmosphere through an outlet 275.

If the pipe stands to be added to the string are held in a rack above rig floor 12, rather than within mousehole 26, the discussed lateral actuation of structure 43 and elevator 24 can serve to move the elevator to a position facititating connection of the elevator to such a racked pipe section, to thereby facilitate connection of the elevator to a pipe offset from the well axis either at a location near the rig floor or at a point high in the derrick.

FIGS. 6 and 7 show a variational arrangement in which a link tilting mechanism **28*a* similar to that previously described is adapted for connection to a hook body 30*a* which is different than the body 30 of FIGS. 1 to 5. As seen in FIG. 7, the hook body 30*a* of the second form of the invention may have two parallel vertically extending plate like projections 78 extending laterally outwardly therefrom, with the mounting bracket structure 44*a* of the device 28*a* including two members 79 of L-shaped horizontal section having side walls 80 secured by bolts 81 to projections 78 of body 30*a*, and having portions 82 projecting toward one another and secured together by one or more rigid metal straps 83 attached to members 79 by bolts 84. A member 85 is secured rigidly to portions 82 of members 79, typically by the same bolts 84 used to secure parts 79 and 83 together, and is pivotally connected at its upper end 86 to structure 43*a* (corresponding to structure 43 of the first form of the invention) to mount that structure for swinging movement about a horizontal axis 87 between the broken line and full line positions of FIG. 6. A bellows structure 66*a* interposed between and connected to members 85 and 43*a* acts when expanded by compressed air to swing structure 43*a*, chains 46*a* and links 25*a* to the full line position of FIG. 6 in which elevator 24*a*** is offset to a side of the well axis to facilitate engagement of the elevator with a length of pipe in a mousehole or withdrawn from a rack.

Figure 10:
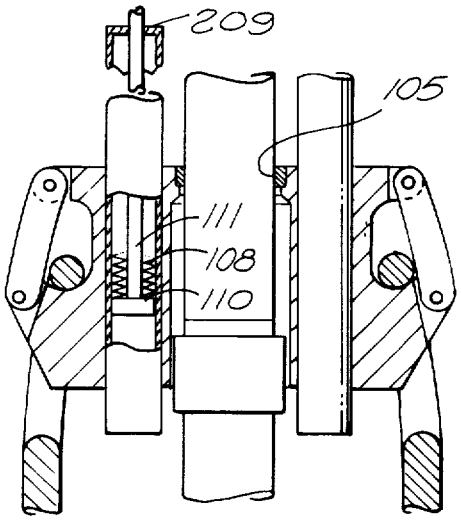
FIG. 10 is an enlarged fragmentary representation of a portion of the apparatus contained within the circle identified by the number 10 in FIG. 9.
Figure 9:
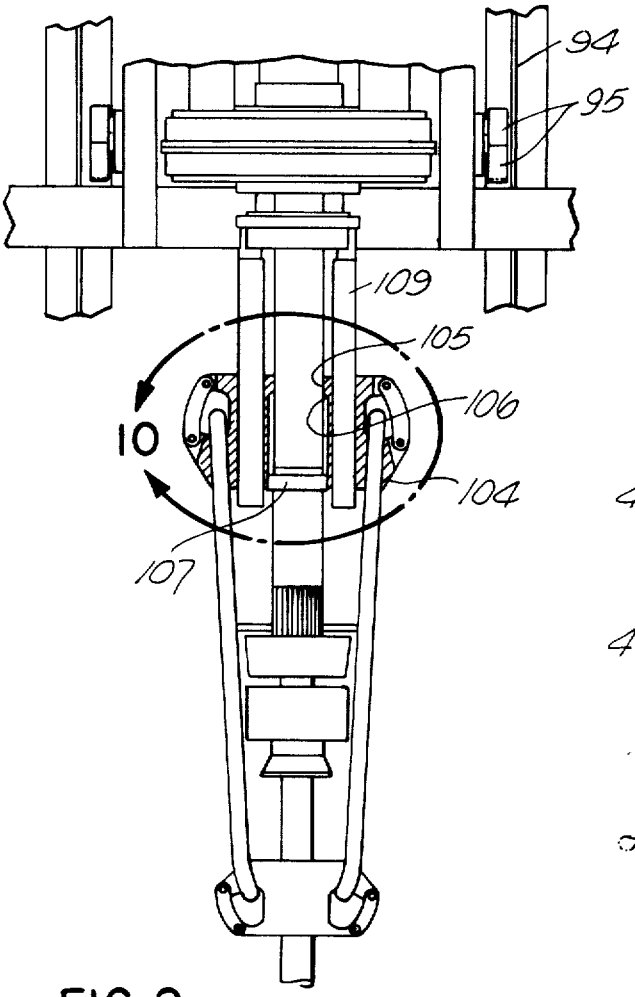
FIG. 9 is a fragmentary elevational view taken on line 9—9 of FIG. 8.
Figure 8:
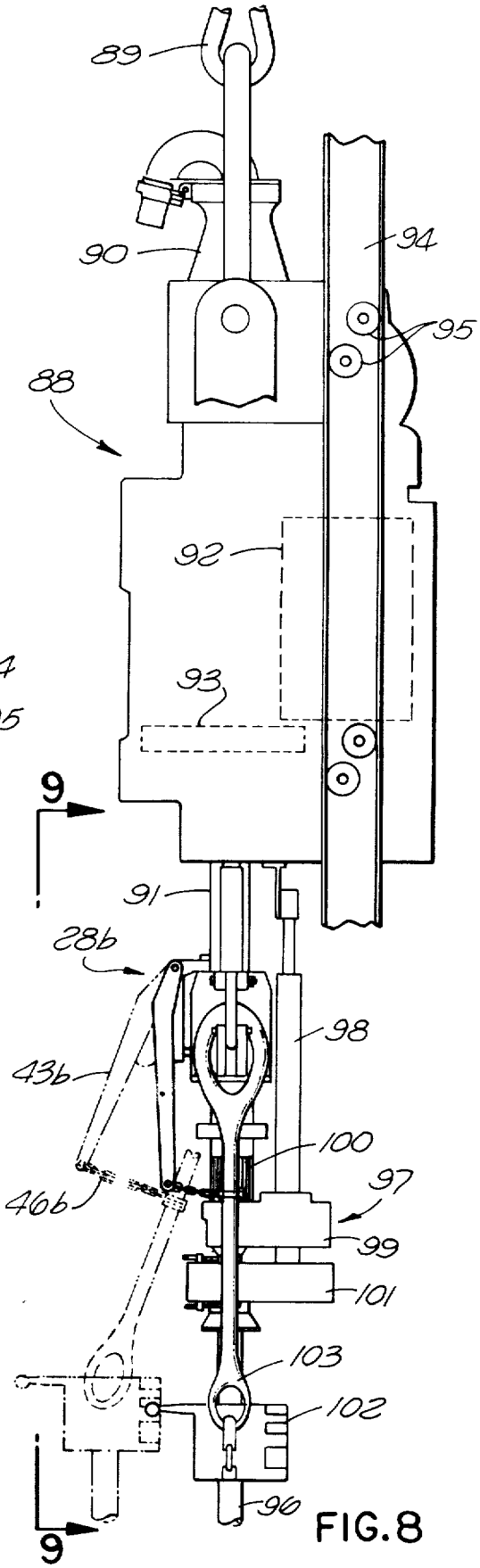
FIG. 8 is a side elevational view of a top drive drilling assembly having a link tilting mechanism embodying the invention.

FIGS. 8 through 10 show application of the link tilting mechanism to a top drive assembly of the type disclosed in copending U.S. Patent application Ser. No. 6/404,896 filed Aug. 3, 1982, Inventor, George, I. Boyadjieff, entitled "Drilling Of Wells Top Drive Unit". The apparatus shown in those figures is illustrated only very generally, to the extent necessary for an understanding of the application of the link tilting mechanism thereto, but is to be understood as preferably including the detailed structural features shown and described in the above identified application. With reference first to FIG. 8, it may be assumed that the top drive assembly 88 shown in that figure is suspended within a derrick similar to that represented at 11 in FIG. 1, with the upper end 89 of the assembly being connected to the travelling block of the rig and being movable upwardly and downwardly thereby. The assembly may be considered as including an essentially conventional swivel 90 through which circulating fluid can be fed downwardly into and through a tubular vertical drive element 91, which is driven rotatively in either direction by a motor 92 within assembly 88 through reduction gears represented diagrammatically at 93. The entire unit 88 is guided for only vertical movement by a pair of vertical rails 94 engaged by rollers 95 attached rotatably to the body of top drive unit 88. The tubular drive element 91 is adapted to be threadedly connected at its lower end to the upper end of a section of drill pipe 96, with the connection being made by a torque wrench 97 suspended from the body of unit 88 by mounting structure 98. This torque wrench includes an upper section 99 adapted to engage a splined portion 100 of member 91, and a lower section 101 adapted to engage and grip the upper end of drill pipe section 96, with these portions 99 and 101 being constructed to turn elements 96 and 100 in opposite directions to either screw them together or threadedly detach them as desired.

The drill pipe section 96 can be supported by an elevator 102, suspended by two links 103 similar to the links 25 previously described, with the upper ends of the links being supported from opposite ends of a link suspending body 104 having a central vertical passage 105 through which tubular drive element 91 extends in a relation locating part 104 relative to element 91 while permitting limited upward and downward movement of the part 104 relative to element 91. In a lower position, an internal annular shoulder 106 in part 104 engages an upwardly facing annular shoulder 107 formed on a flange of element 91 to effectively support member 104 and elevator 102 and a drill pipe section 96 from element 91 through the shoulders. Under light load conditions, member 104 is yieldingly urged upwardly to the FIG. 9 position by two springs 108 contained within two guide tubes 109 which are rigidly attached to body 104, to maintain the shoulders out of engagement. Springs 108 may act upwardly against upper end walls 209 of tubes 109 and downwardly against flanges 110 of a pair of rods 111 rigidly connected at their upper ends to the body of top drive unit 88.

The link supporting body 104 has attached to one of its sides a tilting mechanism **28*b* which may be constructed the same as the mechanism 28 of FIGS. 1 through 5, and whose pivotal structure 43*b* corresponding to structure 43 of the first form of the invention is connected by chains 46*b* to links 103 to swing the links and the suspended elevator 102 from the vertical full line position of FIG. 8 to the laterally displaced broken line position of that figure upon introduction of compressed air or other pressure fluid to the bellows of FIG. 8 corresponding to bellows 66** of the first form of the invention.

When it is desired to add a length of pipe to a drill string utilizing the apparatus of FIGS. 8 through 10, the top drive assembly can be lowered to a level just slightly higher than the upper end of a section of pipe located within the mousehole 26 of FIG. 1, after which tilting mechanism 28*b* can be actuated to swing links 103 laterally to their broken line position in which elevator 102 is directly above the section of pipe in the mousehole, so that upon further lowering of the entire assembly the elevator will be received about the section of pipe in the mousehole and can be closed into gripping engagement therewith to enable the pipe to be pulled upwardly by the elevator as the entire apparatus is elevated in the derrick. The pressure within the bellows can be released, and the links and suspended elevator and pipe section will then swing to positions in which the pipe section is aligned with the well axis and can be connected at its lower end to the upper end of the drill string, with the torque wrench 97 and rotation of element 91 by motor 92 being utilized to make the threaded connection between element 91 and the upper end of the pipe section and between the lower end of the pipe section and the drill string.

While certain specific embodiments of the present invention have been disclosed as typical, the invention is of course not limited to these particular forms, but rather is applicable broadly to all such variations as fall within the scope of the appended claims.

I claim:

1. Well drilling apparatus comprising:

a drilling unit including a rotary element adapted to be connected to the upper end of a drill string for rotation therewith about the axis of the string, and a motor operable to drive said element and the connected string rotatively about said axis;

an elongated guide structure which extends generally vertically parallel to said axis and which guides the drilling unit for movement upwardly and downwardly with a connected drill string to drill a well;

a torque wrench carried at the lower end of said drilling unit in axial alignment with said rotary element for movement upwardly and downwardly with the drilling unit along said axis and having two sections which apply torque in opposite directions to said rotary element and a section of said drill string to make or break a connection therebetween;

two links having upper ends connected to said drilling unit for movement upwardly and downwardly therewith and in a relation suspending the links at opposite sides of said axis;

an elevator connected to lower ends of said links and suspended thereby beneath said torque wrench and adpated to support a section of said drill string in axial alignment with said torque wrench; and power actuated means operable to swing said lower ends of the links and the elevator suspended thereby laterally outwardly relative to said torque wrench in a relation shifting said elevator between a first position in which it is beneath the torque wrench and aligned therewith along said axis to suspend a section of the drill string in axial alignment with the torque wrench and a second position in which the elevator is offset to a side of said axis and is not aligned with the torque wrench, to engage a section of drill pipe offset from said axis, while the torque wrench and drilling unit remain in alignment with said axis.

2. Well drilling appratus as recited in claim 1, including a link support structure connected to said drilling unit for movement upwardly and downwardly therewith along said guide structure and for limited upward and downward movement relative to the drilling unit and relative to said torque wrench, and to which the upper ends of said links are connected to suspend the links.

3. Well drilling apparatus as recited in claim 1, includng a link support structure connected to said drilling unit for movement upwardly and downwardly therewith along said guide structure and for limited upward and downward movement relative to the drilling unit and relative to said torque wrench, and to which the upper ends of said links are connected to suspend the links, said power actuated means for swinging the lower ends of the links and elevator laterally outwardly being connected to said link support structure for movement upwardly and downwardly therewith relative to said drilling unit and relative to the torque wrench.

4. Well drilling apparatus as recited in claim 3, in whch said rotary element of the drilling unit is constructed to support said link support structure and said power actuated means carried thereby in a lower position thereof relative to the drilling unit and torque wrench but does not support the link support structure and power actuated means in an upper position thereof relative to the drilling unit and torque wrench.

5. Well drilling apparatus as recited in claim 3, including means yieldingly urging said link support structure and said power actuated means and said links and elevator upwardly relative to said drilling unit and torque wrench.

6. Well drilling apparatus as recited in claim 1, in which said power actuated means include an arm structure mounted pivotally near an upper end thereof and having a lower portion connected to said links and adapted to swing laterally outwardly to pull the links laterally outwardly, and fluid pressure actuated means for swinging said arm structure and the attached links laterally.

7. Well drilling apparatus comprising:

a drilling unit including a rotary element adapted to be connected to the upper end of a drill string for rotation therewith about the axis of the string, and a motor operable to drive said element and the connected string rotatively about said axis;

an elongated guide structure which extends generally vertically parallel to said axis and which guides the drilling unit for movement upwardly and downwardly with a connected drill string to drill a well;

a torque wrench carried at the lower end of said drilling unit in axial alignment with said rotary element for movement upwardly and downwardly with the drilling unit along said axis and having two sections which apply torque in opposite directions to said rotary element and a section of said drill string to make or break a connection therebetween;

a link support structure disposed about said rotary element and retained against rotation therewith and which is movable upwardly and downwardly relative to said rotary element and said torque wrench;

said rotary element and said link support structure having shoulders which coact in a lower position of the link support structure relative to said rotary element to support the link support structure from the rotary element, and which move away from one another upon upward movement of the link support structure relative to said element and the torque wrench to free said element for rotation relative to the link support structure;

two links having upper ends connected to said link support structure for movement upwardly and downwardly therewith relative to said rotary element and said torque wrench in a relation suspending the links at opposite sides of said axis;

an elevator connected to lower ends of said links and suspended thereby beneath said torque wrench and adapted to support a section of said drill string in axial alignment with said element and said torque wrench; and power actuated means carried by said link support structure for movement upwardly and downwardly therewith and with said links and elevator relative to said rotary element and said torque wrench and operable to swing said lower ends of the links and the elevator suspended thereby laterally outwardly relative to said link support structure and said torque wrench and said rotary element in a relation shifting said elevator between a first position in which it is beneath the torque wrench and aligned therewith along said axis to suspend a section of the drill string in axial alignment with the torque wrench and a second position in which the elevator is offset to a side of said axis and is not aligned with the torque wrench, to engage a section of drill pipe offset from said axis, while the torque wrench and said motor and rotary element of the drilling unit and said link support structure remain in alignment with said axis.

8. Well drilling apparatus as recited in claim 7, including means yieldingly urging said link support structure and said power actuated means and said links and elevator upwardly relative to said rotary element and said torque wrench.

9. Well drilling apparatus as recited in claim 8, in which said power actuated means include a mounting bracket connected to said link support structure, a swinging arm structure pivotally connected near an upper end thereof to said mounting bracket and having a lower portion which swings laterally outwardly and is connected to said links to pull them laterally, and bellows means interposed operatively between said mounting bracket and said arm structure to swing the arm structure outwardly.

10. Well drilling apparatus comprising:

a drilling unit including a rotary element adapted to be connected to the upper end of a drill string for rotation therewith about the axis of the string, and a motor operable to drive said element and the connected string rotatively about said axis;

an elongated guide structure which extends generally vertically parallel to said axis and which guides the drilling unit for movement upwardly and downwardly with a connected drill string to drill a well;

a link support structure which is carried by said drilling unit for movement upwardly and downwardly therewith and for limited upward and downward movement relative to said rotary element;

two links having upper ends connected to said link support structure for movement upwardly and downwardly therewith and relative to said rotary element;

an elevator connected to lower ends of said links and suspended thereby to support a section of said drill string;

shoulders engageable in a lower position of said link support structure and said links and said elevator to support the link support structure and links and elevator and a section of drill string suspended by the elevator from said rotary element, and which shoulders are movable away from one another in an upper position of said link support structure and links and elevator and section of drill string to free said rotary element for rotation relative to the link support structure and links and elevator and section of drill string; and power actuated means connected to said link support structure for movement upwardly and downwardly therewith relative to said rotary element and operable to swing said lower ends of the links and the elevator suspended thereby laterally outwardly relative to said rotary element and said link support structure in a relation shifting said elevator between a first position in which it is beneath said rotary element and aligned therewith along said axis to suspend a section of the drill string at the axis and a second position in which the elevator is offset to a side of said axis.

11. Well drilling apparatus as recited in claim 10, in which said power actuated means include a fluid pressure operated unit connected to said link support structure for movement upwardly and downwardly therewith relative to said rotary element and acting to swing the links laterally outwardly.

12. Well drilling apparatus comprising:

a drilling unit including a rotary element adapted to be connected to the upper end of a drill string for rotation therewith about the axis of the string, and a motor operable to drive said element and the connected string rotatively about said axis;

an elongated guide structure which extends generally vertically parallel to said axis and which guides the drilling unit for movement upwardly and downwardly with a connected drill string to drill a well;

a torque wrench carried at the lower end of said drilling unit in axial alignment with said rotary element for movement upwardly and downwardly with the drilling unit along said axis and having two sections which apply torque in opposite directions to said rotary element and a section of said drill string to make or break a connection therebetween;

an elevator suspended beneath said torque wrench for movement upwardly and downwardly with said drilling unit and torque wrench and adpated to support a section of said drill string in axial alignment with the torque wrench and with said rotary element of the drilling unit; and power actuated means operable to move said elevator laterally outwardly relative to said torque wrench in a relation shifting said elevator between a first position in which it is beneath the torque wrench and aligned therewith along said axis to suspend a section of the drill string in axial alignment with the torque wrench and a second position in which the elevator is offset to a side of said axis and is not aligned with the torque wrench, to engage a section of drill pipe offset from said axis, while the torque wrench and drilling unit remain in alignment with said axis.

13. Well drilling apparatus as recited in claim 12, in which said elevator when in said first position thereof is movable upwardly and downwardly relative to said torque wrench and relative to said rotary element. pg,25

14. Well drilling apparatus as recited in claim 12, in which said elevator when in said first position thereof is movable upwardly and downwardly relative to said torque wrench and relative to said rotary element between a lower position in which the elevator is supported by said rotary element and an upper position in which it is not supported thereby.

* * * * *